United States Patent [19]

Bergt

[11] 3,938,325

[45] Feb. 17, 1976

[54] AERODYNAMIC FLAME HOLDER

[75] Inventor: Wolfgang Bergt, Munich, Germany

[73] Assignee: Motoren- und Turbinen-Union Munchen GmbH, Germany

[22] Filed: Nov. 12, 1973

[21] Appl. No.: 415,003

[30] Foreign Application Priority Data

Nov. 11, 1972 Germany ..... 2255306

[52] U.S. Cl. ..... 60/39.72 R; 60/39.74 R; 60/261

[51] Int. Cl.[2] ..... F02G 3/00; F02K 3/10

[58] Field of Search ..... 60/39.72 R, 261, 39.31, 60/39.74 R

[56] References Cited

UNITED STATES PATENTS

| | | | |
|---|---|---|---|
| 2,693,083 | 11/1954 | Abbott | 60/39.72 R |
| 2,946,185 | 7/1960 | Bayer | 60/39.74 R X |
| 2,979,899 | 4/1961 | Salmon et al. | 60/39.72 R |
| 3,328,958 | 7/1967 | Canvel | 60/39.72 R |
| 3,455,108 | 7/1969 | Clare et al. | 60/39.72 R |
| 3,465,525 | 9/1969 | Cowley et al. | 60/39.72 R |
| 3,605,407 | 9/1971 | Bryce | 60/39.72 R |

*Primary Examiner*—C. J. Husar
*Assistant Examiner*—Thomas I. Ross
*Attorney, Agent, or Firm*—Craig & Antonelli

[57] ABSTRACT

Flame holder apparatus and method of operating same for a burner in a high velocity gas stream of an air-breathing jet engine. A flame holder body of aerodynamically streamlined external configuration is provided which extends spanwise across a high velocity gas stream of the engine. Fuel and air for the burner is supplied by way of a mixing chamber arranged internally of the flame holder body in such a manner that a homogeneous mixture, including all of the fuel necessary for combustion, is provided by way of the flame holder body so that separate fuel injection nozzles become unnecessary. Various preferred embodiments of the invention include arrangements of the flame holder apparatus in the bypass air stream and downstream of the combustion chamber.

18 Claims, 10 Drawing Figures

AERODYNAMIC FLAME HOLDER

BACKGROUND AND SUMMARY OF THE INVENTION

This invention relates to aerodynamic flame holders for airbreathing jet engines. Preferred embodiments include outlet ports in the upper and lower sides of the contour of the flame holder body through which a fuel-air mixture under positive pressure is admitted to the high-velocity air or gas stream wetting the flame holder.

With modern, air-breathing jet engines, thrust augmentation is currently being achieved by means of two different provisions, as follows:

1. Reheating of the turbine exhaust gases in an afterburner
2. Additional combustion of fuel in the cold air stream in bypass ducts (secondary stream).

In both of the above-listed cases the velocity of the gas stream is much too high to sustain stable combustion, and stabilizers must therefore be provided for maintaining combustion. These stabilizers affect the flow of gas around the stabilizers to cause a zone to form behind the stabilizers in which the flow medium recirculates and so induces stable combustion.

Stabilizers of the above-mentioned kind are normally used in the form of rings made of V-shapes (Vee gutter) and are fixedly installed in the combustion chamber space where the afterburning or burning (in the case of combustion in the cold air stream) takes place. However, said stabilizers, together with the fuel injection means needed for the reheating or additional combustion, cause a significant loss in total pressure especially so also at times when reheating or additional combustion cause a significant loss in total pressure especially so also at times when reheating or additional combustion is not needed during certain flight phases. This disadvantageous total pressure loss is all the more significant when one considers that the duration for which afterburners of a flight system are in active use is short as compared with the total flight time of the system.

In order to reduce the loss in total pressure, which ultimately shows up as a loss in performance, so-termed aerodynamic flame holders have been contemplated. These aerodynamic flame holders are of shapes of minimum flow resistance (usually symmetrically shaped) to replace the above-discussed Vee gutters. The function of these flame holders is to blow bleed-air from the high-pressure compressor into the main stream at right or other angles to it whenever reheating or additional combustion is needed. The air issuing from these flame holders causes an umbrella-like shield to form in the main stream which in turn produces a recirculatory zone behind it to promote stable combustion. With this arrangement the fuel needed for combustion must be injected into the recirculatory zone through additional nozzles. This calls for fuel injection means to be installed in the combustion chamber space and these fuel injection means again involve a loss in total pressure, so that the advantage afforded by the flow-promoting contour of the flame holder is partially canceled.

When flame holders such as those described in the preceding paragraph are used, they frequently give trouble from poor ignition in that the mixing process which starts after the fuel has been injected often results in a very incompletely conditioned mixture which is very inhomogeneous and can be lit a few points only. This holds true especially when said flame holders are used in the cold air stream of bypass ducts where the relatively cool air stream impedes the mixing process to an even greater degree. In order to alleviate these mixing troubles a flame holder has been contemplated where a small amount of fuel is already admitted to the stabilizing air within the flame holder, but resort must still be made then to additional fuel injection means outside the flame holder. These additional fuel injection means result in a disadvantageous loss in total pressure as discussed above.

The present invention contemplates providing an aerodynamic flame holder which is simple in design but still ensures reliable ignition of the system and involves no more than a minimal loss in total pressure, or performance, in both the lit and the unlit operating conditions.

This invention more particularly contemplates providing a flame holder where the entire fuel needed for combustion in the afterburner or in the bypass stream is internally mixed with air in a mixing chamber enclosed by the flame holder and is then admitted to the outside gas stream in a condition already premixed with air and processed for ready ignition. This supply of all necessary fuel by way of the flame holder mixing chamber obviates the need for fuel injection means outside the flame holder and so eliminates the attendant loss in total pressure or performance in both the lit and the unlit operating conditions. Since the invention provides a fully integrated system of flame holder, fuel injection means and mixing chamber, it enables the flame holder to be contoured for optimum flow for maximum benefit to the overall system aerodynamically.

With the flame holder of the present invention the fuel needed for combustion is admixed not only partly but wholly to the stabilizing air already before it issues from the flame holder. In this process the fuel is not simply injected into the stabilizing air stream but after the fuel has been admitted the fuel-air mixture is first conditioned in a separate mixing chamber where it turns into an ignitible, homogeneous blend. This mixing chamber advantageously ensures that sufficient time is allowed for fully conditioning the fuel-air mixture for ignition and ensures that fuel can be swirled and thoroughly blended as needed for homogeneous distribution throughout the mixture.

Owing to the fact that the mixture issuing from the mixing chamber through the outlet ports has already been conditioned for ready ignition, ignition of the mixture will reliably take place whenever needed.

This invention also provides a further advantage over conventional, not fully integrated systems in that it reduces the overall length of the afterburner since the previously known systems having fuel injection means outside the flame holder require a certain minimum distance between fuel injection means and flame holder for conditioning the fuel-air mixture. Also, by eliminating external fuel injection means which interfere with the main stream the flame holder of the present invention provides an additional advantage in that the distribution of the issuing ignitible mixture can be optimally adapted to the needs of the respective engine and that the temperature profile attending combustion can be largely controlled by suitably selecting the geometry, distribution and orientation of the outlet ports.

A further advantage provided by the present invention is that the amount of compressed air needed for a ertain depth of penetration of the stabilizing medium ıto the main stream of gas is reduced in keeping with ıe fuel content in the stabilizing air. Still another adantage is that the pressure level of the stabilizing air sed in the process can be relatively low, so that the air eeded can be drawn from the low or intermediate ressure portion of the compressor. The two last cited dvantages are of great importance considering that he amount and pressure level of the air needed for tabilizing the flame are often exceedingly important if ot determinant criteria in practical applications. That ;, the efficiency of the total engine system is signifiantly improved by reducing the pressure requirements or the stabilizing air.

In preferred embodiments of the present invention he mixing chamber is constructed as a hole or hollow pace which extends at right angles to the direction of he main flow and over the entire span of the flame ıolder. One or more lateral inlet ducts leading to said ıollow space are provided. Each inlet duct is provided vith an air feed line and a fuel line such that the fuel is tomized and initially admixed to the feed air while still n the inlet duct. The actual conditioning and further nixing to produce a homogeneous ignitible mixture akes place downstream of the inlet duct in the mixing hamber.

A flame holder arranged in accordance with the presnt invention is simple in design and construction and herefore relatively economical to manufacture.

In preferred embodiments of the present invention, a ılurality of inventive flame holders are arranged in tellate or annular symmetry in the respective combusion area. This type of arrangement aids in the uniform ıeating of the main gas stream across the combustion ırea.

These and further objects, features and advantages of he present invention will become more obvious from he following description when taken in connection vith the accompanying drawings which show, for purposes of illustration only, several embodiments in acordance with the present invention.

DETAILED DESCRIPTION OF THE DRAWINGS

Figure 1:
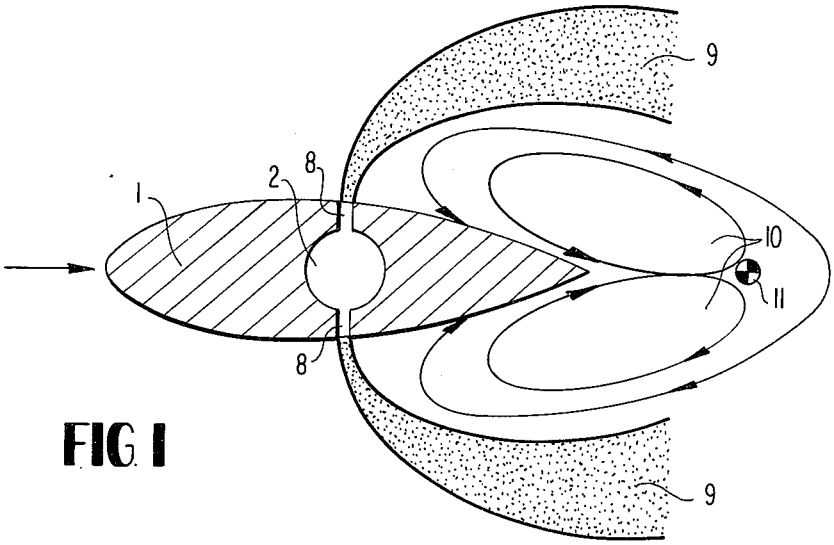
FIG. 1 is a cross-sectional schematic view of an emodiment of apparatus constructed in accordance with he present invention.
Figure 2A:
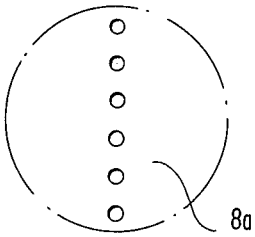
FIGS. 2*a* and 2*b* are enlarged detailed views illustrtng optional arrangements of a portion of the structure f FIG. 2.
Figure 2B:
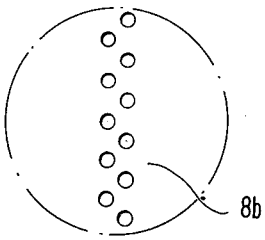
Figure 2:
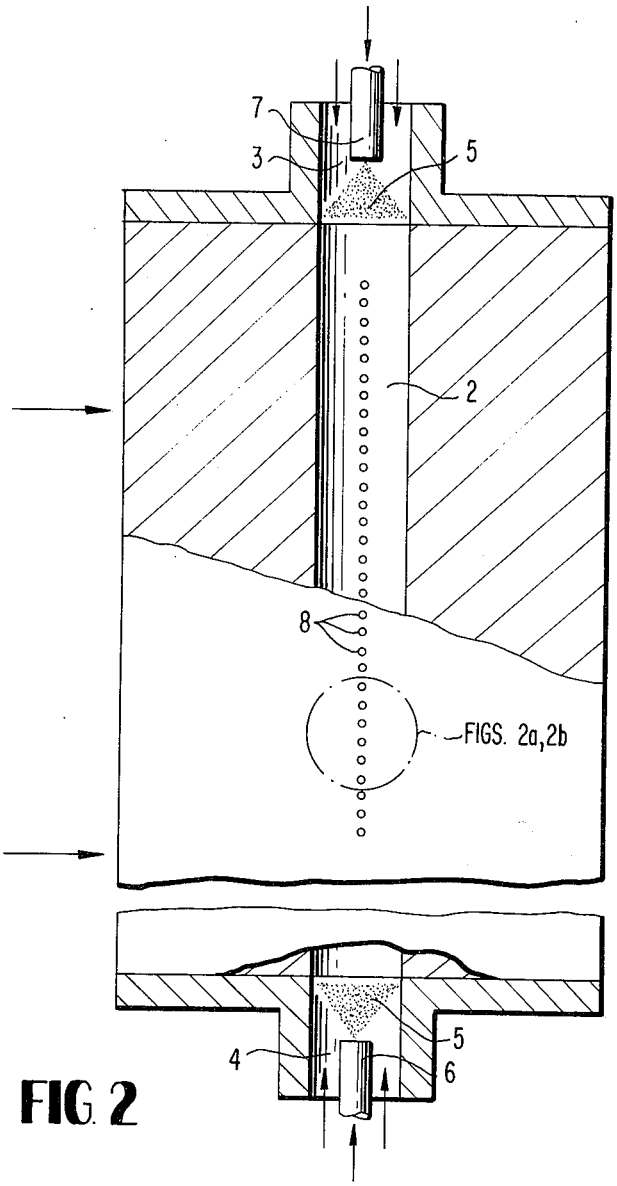
FIG. 2 is a schematic plan view of the embodiment of IG. 1.

The flame holder body 1 (FIGS. 1 and 2) has a shape which provides minimum resistance to flow (shown on the drawing as a symmetrical contour having a relative thickness/chord ratio of 50%) and encloses a mixing chamber 2 which takes the shape of a hole extending perpendicularly to the main flow (large arrow at left of body 1 depicting direction of main flow) and across the entire span of the flame holder (FIG. 2). The mixing chamber 2 is supplied with air through laterally arranged inlet ducts 3 and 4 on the flame holder body 1, into which ducts atomized fuel 5 is admitted through injection means 6 and 7 arranged just before the entrance of the ducts 3 and 4 to the mixing chamber 2. In the FIG. 2 embodiment fuel is admitted through atomizer swirl nozzles, however other types of fuel injection means of known types can also be used with the present invention.

The present invention also contemplates embodiments with means for combining fuel supply and air supply into a single component, such as an air-powered nozzle. In FIG. 2 air-fuel is supplied to the mixing chamber from both sides. If certain applications make it desirable, however, air-fuel can also be fed from one side only (for example see FIG. 6).

Figure 3:
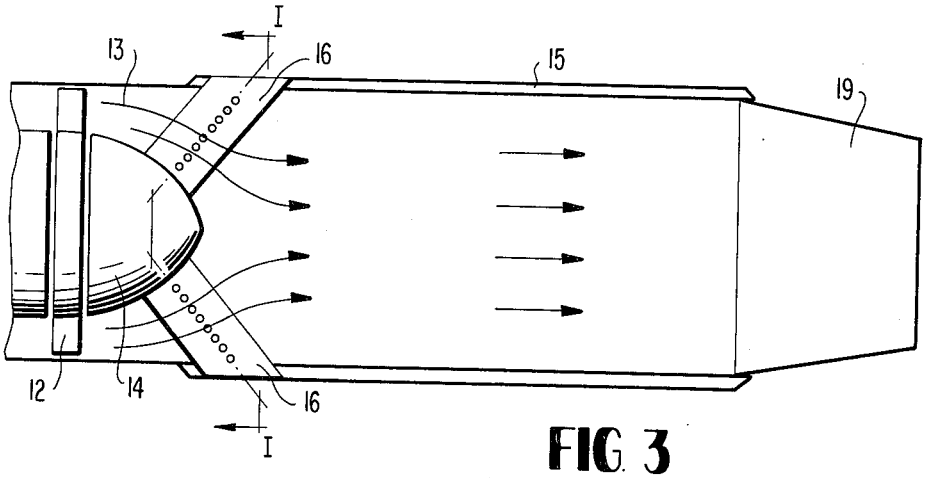
FIG. 3 is a longitudinal sectional schematic view llustrating an embodiment of the present invention vith a stellate arrangement of flame holders in an afterurning system.
Figure 4:
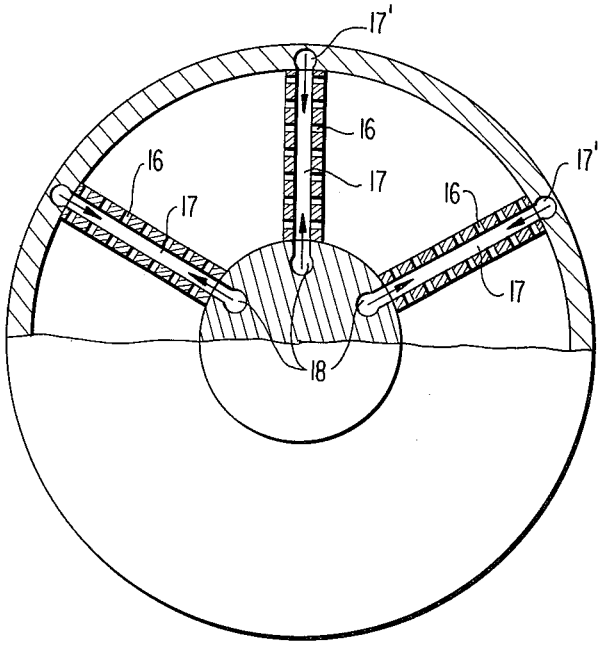
FIG. 4 is a sectional view taken along line I—I in FIG.

Owing to the particular location of the fuel supply the atomized fuel is premixed with feed air in the inlet ducts 3 and 4 prior to entry into the mixing chamber 2. The available volume of the mixing chamber enables the previously initiated mixing process to be continued and, additionally, the fuel-air mixture to be homogenized, after which it issues ready for ignition and under positive pressure from the flame holder 1 through outlet ports 8. While the outlet ports 8 are here shown in the form of holes, their geometry (e.g., 8*a*, 8*b*), as well as their arrangement and orientation, may be adapted to the particular intended application. After the fuel-air mixture 9 issues from the flame holder 1 through outlet ports 8, it enters the outside flow and causes the flow hugging the contour of the flame holder to separate from it (FIG. 1) to form a zone 10 where the flow recirculates. The presence of this recirculatory flow facilitates stable combustion. An igniting means 11 within this recirculatory zone is employed to ignite or light the mixture FIGS. 3 and 4 illustrate a stellate arrangement of flame holders in accordance with this invention in an afterburning system. The exhaust gas 13 issuing from the guide apparatus 12 of the turbine flows towards the flame holders 16 which are here (FIG. 3) disposed in stellate arrangement across the flow area between a diffusor 14 and an afterburner area 15. The ignitible fuel-air mixture issuing from the mixing chambers 17 of the flame holders 16 produces the recirculatory zone needed for stable combustion and supplies the afterburner 15 with all the fuel it needs for reheating. Stabilizing air and fuel is fed to the flame holders 16 through respective fuel and air lines 17′ and 18. The reheated exhaust gases leave the afterburner through a nozzle 19 (FIG. 3). For details of the mixing chambers and the inlets and outlets thereto and for details of the shape of the holders see the above description of similar features in the FIGS. 1 and 2 embodiments.

Figure 5:
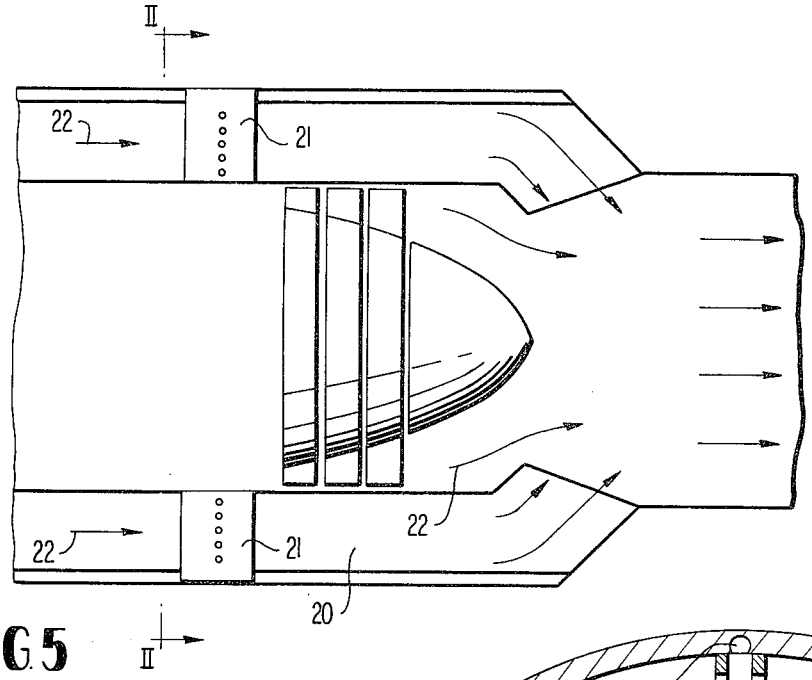
FIG. 5 is a longitudinal sectional schematic view llustrating another embodiment of the present invenion with stellate arrangement of flame holders in a ypass system.
Figure 6:
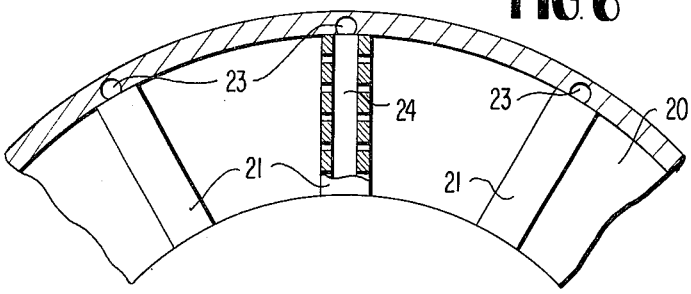
FIG. 6 is a sectional view taken along line II—II in IG. 5.

FIGS. 5 and 6 illustrate flame holders in accordance with this invention disposed in stellate arrangement in a bypass duct. The cold air 22 flowing to the flame holders 21 in the bypass duct 20 is heated in the bypass duct and admixed to the turbine exhaust gases (FIG. 5). The fuel needed for combustion to heat the cold air, and also the stabilizing air, is supplied to the flame holders 21 at one end through the fuel and/or air lines 23 (FIG. 6). The fuel-air mixture is then conditioned in the mixing chamber 24 for ignition. See the FIGS. 1 and 2 description for other details of the individual flame holders.

Figure 7:
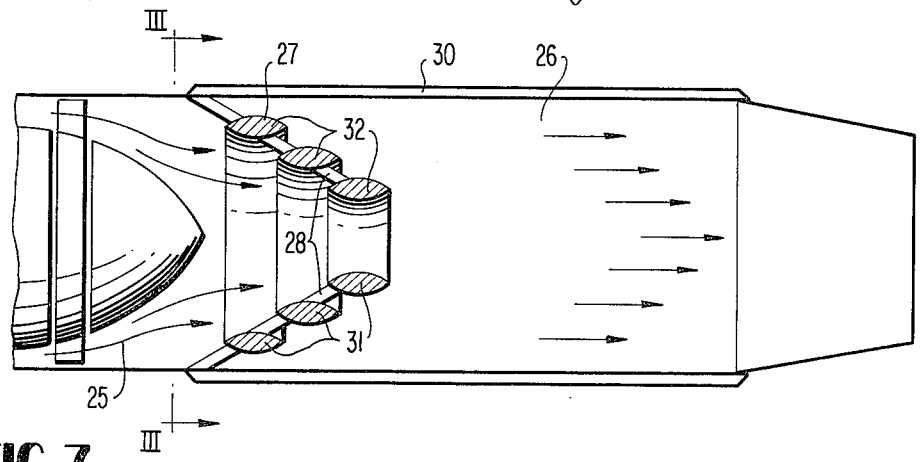
FIG. 7 is a longitudinal sectional schematic view llustrating another embodiment of the present invenion with an annular arrangement of flame holders in an fterburning system.
Figure 8:
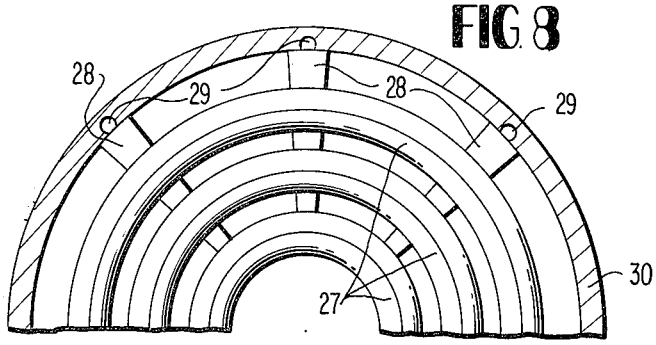
FIG. 8 is a sectional view taken along line III—III in FIG. 7.

FIGS. 7 and 8 illustrate an annular arrangement of the flame holders in accordance with this invention for use in an afterburner. The exhaust gas 25 issuing from the turbine guide apparatus flows to the flame holders 27 which are annularly arranged in the flow area between a diffusor and an afterburner area 26 (FIG. 7 or 8). The stabilizing air, as well as the fuel to be injected, is supplied to the various flame holders through struts 28. The holes 29 in the housing 30 serve to supply stabilizing air and fuel to the struts 28. After conditioning in the mixing chambers 32 the ignitible mixture issues from the flame holder 27 through holes 31. See the FIG. 1 and 2 description for details of the individual flame holder cross-section and for details of the mixing chambers and inlets and outlets thereto.

The direction the flow of gas is taking through the jet engine is generally indicated in FIGS. 1 to 8 by arrowheads.

To further assist in an understanding of the present invention, following are specific dimensional features of a practical construction of the preferred embodiment of FIGS. 1 and 2:

Diameter range for mixing chamber: 1.8 cm – 2.0 cm
Profile - length 5–15 cm, maximum thickness: 2–2.5 cm
Diameter range for openings 8: 0.1 mm to 0.4 mm
Pressure in mixing chamber 2: minimum 3–5 atmospheres (pressure above atmosphere)
Fuel pressure: 20–50 atmospheres (pressure above atmosphere)
Amount of air flow in the mixing chamber compared to the amount of flow in the main gas stream: approximately 2–5% . . . equivalent ratio = (amount of fuel as compared to the amount of air in the mixing chamber 2) real: (amount of fuel as compared to the amount of air in the mixing chamber) stoichiometric = 0.2 – 1.0 (in the region of stable combustion MA mach number = 0.1 – 0.4)

While I have shown and described several embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. Flame holder apparatus for a burner in a high velocity gas stream of an air-breathing jet engine; said apparatus comprising:

flame holder body means extendible spanwise across a high velocity gas stream of an engine, said flame holder body means having an aerodynamically streamlined external configuration with respect to the flow of said gas stream therearound, mixing chamber means formed inside said flame holder body means, fuel supply means opening into said mixing chamber means for supplying atomized fuel thereto, air supply means opening into said mixing chamber means for supplying air thereto, said mixing chamber means including means for premixing the atomized fuel and air supplied thereto to form a premixed fuel-air mixture inside said mixing chamber means.

and outlet means leading from said mixing chamber to the surface of said flame holder body means for supplying said fuel-air mixture under pressure to the gas stream flowing over said flame holder body means to support combustion in said gas stream, wherein said fuel supply means includes means for supplying all fuel for supporting combustion in said burner by way of said mixing chamber such that all fuel is supplied through said, outlet means in a premixed condition ready for ignition, wherein said mixing chamber means is formed as a hollow space having a longitudinal axis extending in the spanwise direction at right angles to the flow of said gas stream over the entire span of the flame holder body means, wherein inlet duct means are provided at at least one spanwise end of said flame holder body means, and wherein said fuel supply means and said air supply means both open into each of said inlet duct means in the direction of the longitudinal axis of said hollow space such that the fuel is atomized and partially admixed with the air from said air supply means within said inlet duct means at a position upstream of the mixing chamber means.

2. Apparatus according to claim 1, wherein said outlet means includes a plurality of openings in the external surface of said flame holder body means, said flame holder body means exhibiting an external configuration cross-section which is symmetrical with respect to centerline means extending transverse to said spanwise direction and in the direction of flow of said gas stream such that said gas stream flows over the surface portions of said holder body means at both sides of said centerline means, and wherein said openings are provided in the surface portions of said flame holder body means at both sides of said centerline means.

3. Apparatus according to claim 1, further comprising a bypass duct in a jet engine for guiding flow of high-velocity cold bypass air, wherein said flame holder body means extends spanwise across portions of said bypass duct with said cold bypass air flowing thereover as said gas stream.

4. Apparatus according to claim 1, further comprising an exhaust duct in a jet engine for guiding flow of high-velocity exhaust gases from a combustion chamber of said engine, wherein said flame holder body means extends spanwise across portions of said exhaust duct with said exhaust gases flowing thereover as said gas stream.

5. Apparatus according to claim 1, wherein said inlet duct means conducts said fuel and air directly into said mixing chamber where it is mixed and conditioned to produce a homogeneous ignitable mixture.

6. Apparatus according to claim 1, wherein said flame holder body means includes a plurality of separate flame holder bodies which extend in a stellate manner across a duct of said engine which guides said jet stream.

7. Apparatus according to claim 1, wherein said flame holder body means includes a plurality of separate flame holder bodies which extend annularly around a central axis of a duct of said engine which guides said jet stream.

8. Apparatus according to claim 6, wherein said flame holder bodies are arranged symmetrically with respect to a central axis of said duct.

9. Apparatus according to claim 8, wherein said flame holder bodies extend spanwise in radial directions extending perpendicular to said central axis.

10. Apparatus according to claim 8, wherein said flame holder bodies extend spanwise in radial directions and inclined with respect to said central axis.

11. Apparatus according to claim 7, wherein said flame holder bodies are arranged symmetrically with respect to a central axis of said duct.

12. Apparatus according to claim 6, wherein said flame holder body means extend from inner to outer walls of duct means which guide said gas stream.

13. Apparatus according to claim 2, wherein said openings are positioned along lines extending approximately through the midpoint of said side portions as seen in the direction of flow of said gas stream.

14. Apparatus according to claim 2, wherein said fuel-air mixture is introduced to said gas stream under sufficient pressure to effect a separation of the flow of said gas stream over said flame holder body means and a formation of a recirculation zone of stable combustion, and wherein ignition means are provided at said recirculation zone to ignite said fuel-air and gas stream mixture.

15. Apparatus according to claim 1, wherein said air supply means includes line means for conducting air from one of a low and intermediate pressure portions of a compressor of said engine as the only source of air for said mixing chamber.

16. Apparatus according to claim 1, wherein said air supply means feeds air into said inlet duct in surrounding relationship to said fuel supply means.

17. Apparatus according to claim 16, wherein said mixing chamber means has a cylindrical configuration.

18. Apparatus according to claim 17, wherein said inlet duct means are provided at two spanwise ends of said flame holder body means, and wherein said air and fuel are admixed in said inlet duct means immediately upstream of the mixing chamber means.

* * * * *